United States Patent [19]

McClelland

[11] Patent Number: 5,041,072

[45] Date of Patent: Aug. 20, 1991

[54] METHOD OF MAKING FLAPPED ENVELOPE WITH PEEL-OFF STRIP FOR BAND OF PRESSURE-SENSITIVE ADHESIVE

[75] Inventor: E. Leslie McClelland, Lancaster, Ohio

[73] Assignee: Cyril-Scott Company, Lancaster, Ohio

[21] Appl. No.: 420,887

[22] Filed: Oct. 13, 1989

[51] Int. Cl.[5] ..... B31B 23/24; B31B 23/62

[52] U.S. Cl. ..... 493/188; 493/212

[58] Field of Search ..... 493/212, 213, 214, 215, 493/220, 923, 927

[56] References Cited

U.S. PATENT DOCUMENTS

| | | | |
|---|---|---|---|
| 2,483,604 | 10/1949 | Abramson | 229/80 |
| 3,512,457 | 5/1970 | Watanabe | 493/192 |
| 4,759,643 | 7/1988 | Canno | 383/84 |
| 4,767,654 | 8/1988 | Riggsbee | 493/220 |
| 4,785,940 | 11/1988 | Wilson | 206/632 |
| 4,854,610 | 8/1989 | Kwiatek | 156/234 |

*Primary Examiner*—William E. Terrell

*Attorney, Agent, or Firm*—Cushman, Darby & Cushman

[57] ABSTRACT

In making the product, the manufacturer coats a longitudinal band of a web with a release coating. A longitudinal pressure-sensitive adhesive strip is applied in a longitudinal band on the web. Transverse glue lines are provided and the web is longitudinally folded, bringing two portions of the web into face-to-face contact. As a result, the transverse glue lines define individual envelope pockets and the release-coated surface on the first web portion becomes applied to the longitudinal adhesive strip on the second web portion. At the same time, the release-coated band of the first web portion is longitudinally severed from the remainder of the first web portion, thereby creating a separate peel-off strip removably covering the band of pressure-sensitive adhesive. The peel-off strip is manufactured while the envelope is being manufactured, and out of the same paper or paper-like material. The manufacturer can print, e.g. in multi-colors, on the portion of the web that becomes the peel-off strip, so that it can bear more attractive, more imaginative graphics, and registration of the peel-off strip on the web is a automatic task.

8 Claims, 1 Drawing Sheet

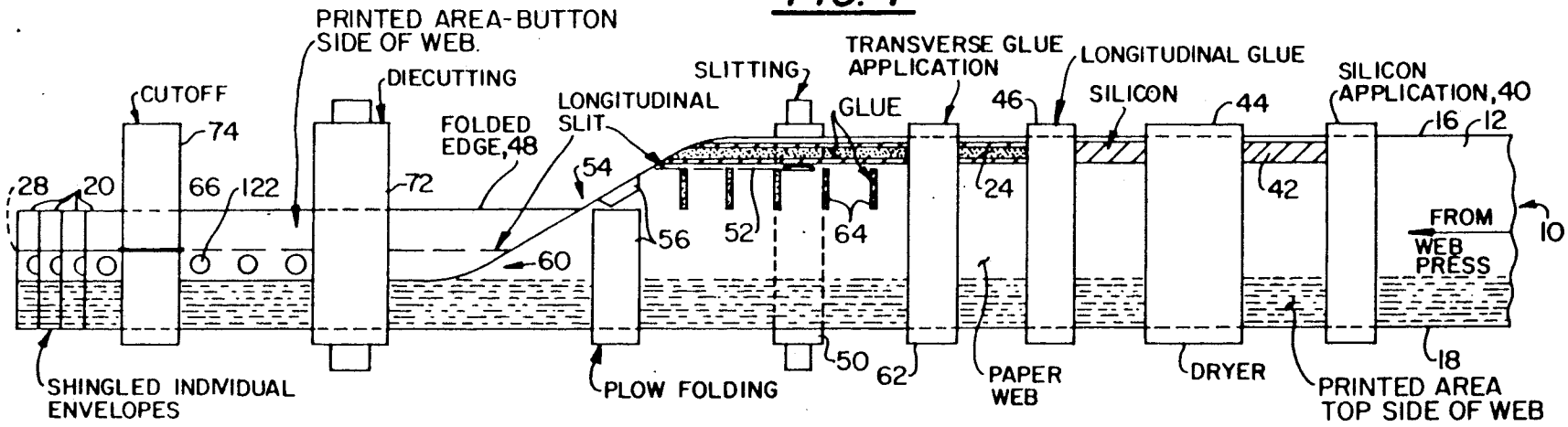
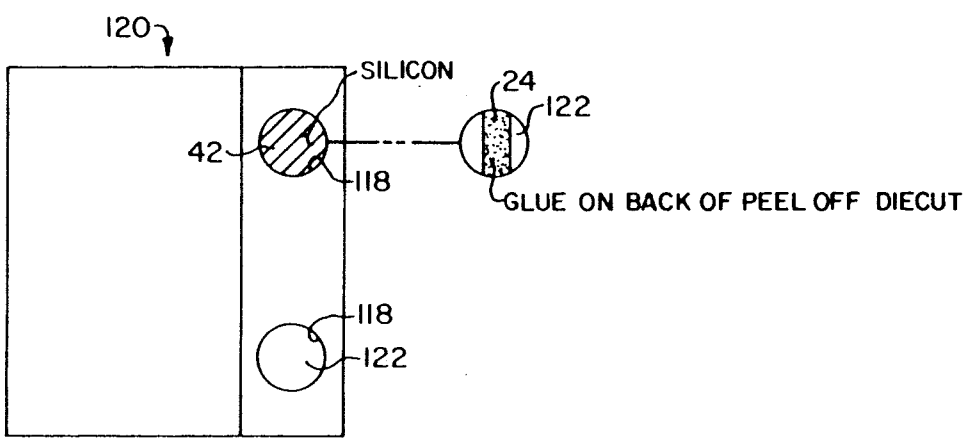
FIG. 3
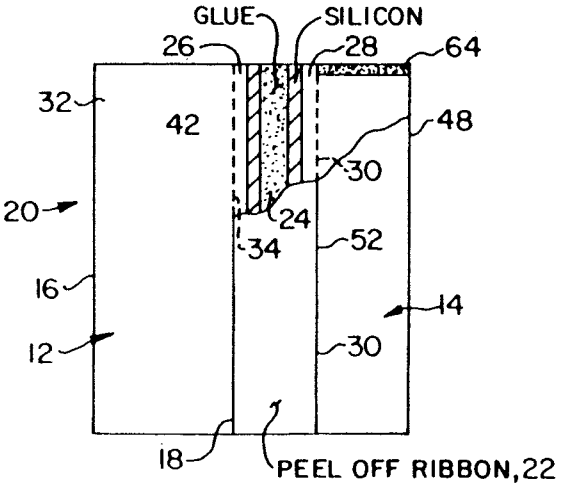
FIG. 2

METHOD OF MAKING FLAPPED ENVELOPE WITH PEEL-OFF STRIP FOR BAND OF PRESSURE-SENSITIVE ADHESIVE

BACKGROUND OF THE INVENTION

The present invention relates to flapped envelopes of the type having a band of pressure-sensitive adhesive initially covered by a peel-off strip. In use, the user places something in the envelope, peels off the cover strip to expose the pressure-sensitive adhesive, and folds the flap over so that it becomes adhered by the adhesive, thus holding the envelope in a closed condition.

Such envelopes are often used in sets of business forms, and as magazine inserts, for facilitating the making by a recipient of a desired response, e.g. to pay a bill, accept an offer or respond to an appeal.

In manufacturing a conventional envelope of this type, the manufacturer applies a line of glue to a product e.g. a series of envelopes being made in web form, then protects the glue by covering it with a cover strip that is pre-manufactured (usually by others) so as to have a release coating on one side and (optionally) some printing (such as the word "PEEL") on the other side.

Disadvantages: the peel-off strip is made separately and (if purchased from others) bears unimaginative printing, and is applied to the glue line in a separate step, which makes registration a difficult task.

SUMMARY OF THE INVENTION

In making the product, the manufacturer coats a longitudinal band of a web with a release coating. A longitudinal pressure-sensitive adhesive strip is applied in a longitudinal band on the web. Transverse glue lines are provided and the web is longitudinally folded, bringing two portions of the web into face-to-face contact. As a result, the transverse glue lines define individual envelope pockets and the release-coated surface on the first web portion becomes applied to the longitudinal adhesive strip on the second web portion. At the same time, the release-coated band of the first web portion is longitudinally severed from the remainder of the first web portion, thereby creating a separate peel-off strip removably covering the band of pressure-sensitive adhesive. The peel-off strip is manufactured while the envelope is being manufactured, and out of the same paper or paper-like material. The manufacturer can print, e.g. in multi-colors, on the portion of the web that becomes the peel-off strip, so that it can bear more attractive, more imaginative graphics, and registration of the peel-off strip on the web is a automatic task.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 1 is a schematic view of a production line for producing a product in accordance with principles of the present invention;

FIG. 2 is a plan view, partially broken away to expose otherwise hidden details, of a first embodiment of a product in accordance with principles of the present invention; and FIG. 3 is a plan view, partially exploded, of a second embodiment thereof.

DETAILED DESCRIPTION

In FIG. 1, the manufacturing process is practiced on a web 10, e.g. made of paper or equivalent flexible sheet material having two opposite faces 12, 14, two opposite edges 16, 18, and an indeterminate length in a longitudinal direction.

At least in a preferred embodiment of the invention, the object is to manufacture out of the web a succession of individual flapped envelopes 20 (FIG. 2), each having a peel-off strip 22 covering a band 24 of pressure-sensitive adhesive arranged so that upon peeling off the strip 22, the flap 26 can be folded along a line of weakness 28 so as to have a face thereof be brought into adhering contact with the band 24 of adhesive, thus closing and holding closed the mouth 30 of the envelope. In manufacturing the envelope 20, it may be convenient to simultaneously manufacture a remittance stub or the like 32 which remains connected to the envelope, e.g. along the outer edge 34 of the flap 26. In responding to the offer made by the product, or in otherwise using the product, the user may detach the stub 32 along a line of weakness 34 coincident with the outer edge of the flap 26, complete the stub 32 with requested information, enclose it, e.g. with a form of payment, a roll of exposed film or the like, through the envelope mouth 30 into the pocket of the envelope, and then peel off the strip 22, fold the flap 26 on the line of weakness 28, and close and seal the envelope, as indicated above.

Returning to the manufacturing process as schematically depicted in FIG. 1, the web 10, upon reaching the first station depicted at the right end of the Figure, has already been printed, e.g. in a conventional multi-color web-fed printing press, e.g. so as to have printing on both the face 12, but also, if desired, on the face 14, and not only on the portion that will become the body and/or flap of each envelope, but also, if desired, on the portions that will become the peel-off strip 22 and/or the remittance stub 32. Such printing is symbolically illustrated in the drawing figures.

At a station 40, symbolically indicated by a roll, but which may conventionally include a set of rolls, a jetting nozzle or any conventional means, a longitudinal strip of release coating material 42 is applied to the face 12 of the web 10. In the instance depicted, the strip 42 is spaced inwardly from but lies adjacent the edge 16 of the web. The release coating strip 42 may be made of any of a plurality of commercially available materials, colloquially known as "silicon", the purpose of which is to provide the web, in a localized area on one face, with a surface which can be peeled away from a band of pressure-sensitive adhesive provided on another not similarly coated region of a face of the web, without splitting, layering, tearing, delaminating or the like.

The release coating strip 42 is conventionally dried or cured at a next station 44. Depending on the nature of the coating, the station 44 may apply heat and air, ultraviolet light, or whatever is needed to produce the desired result.

At the next station, 46, a longitudinal band of pressure-sensitive adhesive 24 is applied on the face 12 of the web 10.

In the preferred embodiment depicted in FIG. 1, the longitudinal band of pressure-sensitive adhesive 24 is laid down on top of, i.e. is superimposed directly upon the release coating strip, the band of adhesive 24 preferably being narrower than, but centered upon the strip 42 of release coating material. Later on in the process, as the web 10 is folded along a longitudinal line 48 (as will be further described below), the band of adhesive 24 is transferred to and thereby provided on an uncoated location on the face 12 of the web 10, on the opposite side of the longitudinal fold line 48 from the release coating strip 42.

In the instance depicted, the station 46 for applying the band of pressure-sensitive adhesive 24 is schematically represented by a roll. In actual practice, any convenient, conventional means may be used.

At a further depicted station 50, the web 10 is longitudinally slit, using a conventional slitter, to provide a slit line 52 which to one side will define the peel-off strips 22 of the individual envelopes.

At a further depicted station 54, the slit web 10 is plow folded, using a conventional plow folder 56, along a longitudinal fold line 48, which lies more medially of the web 10 than does the strip of release coating material 42, whereby the layer of pressure-sensitive adhesive material 24 is applied onto a longitudinal region 60 of the band on the opposite side of the fold line 48.

Back-tracking, the process depicted in FIG. 1, further preferably includes some additional steps, namely: at 62, transverse strips of glue 64 are applied to the face 12 of the web 10 at intervals corresponding to what will become left and right marginal portions of the individual envelopes. As is conventional, the strips 62 may each be so broad that when the web is successively cut-off transversally, each cut is made half way along the width of each glue strip 64, so that each glue strip 64 become the left margin of one envelope pocket, and the right edge of another one. Or, the glue strips may be provided as discrete longitudinally adjacent transverse glue lines, with the transverse cut-off cuts being performed between adjacent lines of the same pair, in which case one line forms the left margin of the pocket of one envelope, and the other forms the right margin of another envelope. The transverse glue lines adhere to corresponding portions of the same face of the web, forming the succession of envelope pockets, as the plow folding is accomplished at 54. Further, a longitudinal fold line and/or a longitudinal line of weakness 28 may be formed in the web 10 at 66 in order to define the base of the flaps 26. In addition, if the product is to include a remittance stub that is easily detachable from the envelope flap 26, a longitudinal perforation line or other line of weakness 34 is conventionally provided at 50.

The die-cutting station 72 may be used for providing lines of weakness, cut-out potential windows or the like.

At a further station 74, the folded and adhered web is cut crosswise by conventional cutting means, into a succession of the individual flapped envelopes 20, one of which is depicted in FIG. 2.

Other stations than those shown may further be provided, e.g. a non-impact, computerized printing station can be provided for printing personalized (e.g. addressee-specific) information on what will become the individual envelopes, before the web is transversally cut into a succession of individual envelopes.

As another elaboration, the production line shown in FIG. 1 may be a part of a production line for a magazine or similar printed publication, in which the individual envelopes 20 are meant to be inserted as bound-in, adhered-in, or blown-in inserts.

The area that is to become the peel-off strip could be longitudinally slit from the web downstream from, rather than upstream of the longitudinal plow-folding of the web.

In the variation shown in FIG. 3, the web, 10 rather than or in addition to having been longitudinally slit, (as at 52 in FIGS. 1 and 2) is die cut (as indicated at 118 in FIG. 3) in a succession of regions overlying the strip of release-coating material, so that each specimen 120 of ultimate product has at least one die cut seal, token, wafer or the like 122, which the user can peel off from the strip of release coating material 42 and stick (i.e., by means of adhesive 24) to, e.g. an acceptance-denoting area on a remittance stub to be inserted in the envelope, if the specimen 120 also constitutes a return envelope.

It should now be apparent that the flapped envelope with manufactured-in-line peel-off strip for band of pressure-sensitive adhesive as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for making a plurality of individual flapped envelopes, each with a manufactured-in-line peel-off strip for a band of pressure-sensitive adhesive, comprising:

(a) providing a web of flexible sheet material of indeterminate length, said web having two opposite faces and two laterally opposite edges, a longitudinal direction and a transverse direction;

(b) coating onto one face of said web, a longitudinal strip of release coating material and drying or curing said coating to provide a release coating strip;

(c) coating onto one of a non-release coated region of said one face of said web and said release coating strip, a longitudinal band of pressure-sensitive adhesive;

(d) folding said web longitudinally thereof along a longitudinal fold line so arranged as to cause said band of pressure-sensitive adhesive to become both removably covered by said longitudinal strip of release coating material and preferentially adhered to said one face of said web in said non-release coated region;

(e) longitudinally slitting said web between said release coating strip and said longitudinal fold line, along a longitudinal slit line, to provide a peel-off strip releasably covering said band of pressure-sensitive adhesive;

(f) cutting said web crosswise into a succession of separate elements, each having a left edge and a right edge; and (g) connecting plies of each said element together along respective left and right edges thereof, from said longitudinal fold line to said longitudinal slit line to create in each said element a pocket open along said longitudinal slit line.

2. The method of claim 1, wherein:

steps (b)-(f) are conducted on successive increments of said web as said web is continuously advanced.

3. The method of claim 2, further comprising:

prior to conducting step (b), printing in a plurality of colors on said web, including on such part of said web as will as a result of conducting step (e) become said peel-off strip.

4. The method of claim 2, further comprising:

after conducting step (d), but prior to conducting step (f), die cutting succession of line-enclosed areas through said region of said web, so that each said element as created in step (f) contains at least one such area, as a removable, pressure-sensitive adhesive-backed member.

5. The method of claim 2, further comprising:

providing said web with a longitudinal line of weakness in thicknesswise registry with said longitudinal slit line, for defining a fold line for a flap base.

6. The method of claim 5, further comprising:

providing said web with a longitudinal line of weakness located for permitting a remittance stub to be easily severed from a closure flap for each said pocket.

7. A method for making a plurality of individual magazine inserts, each with a manufactured-in-line removable pressure sensitive adhesive-backed wafer, comprising:

(a) providing a web of flexible sheet material of indeterminate length, said web having two opposite faces and two laterally opposite edges, a longitudinal direction and a transverse direction;

(b) coating onto one face of said web, a longitudinal strip of release coating material and drying or curing said coating to provide a release coating strip;

(c) coating onto one of a non-release coated region of said one face of said web and said release coating strip, a longitudinal band of pressure-sensitive adhesive;

(d) folding said web longitudinally thereof along a longitudinal fold line so arranged as to cause said band of pressure-sensitive adhesive to become both removably covered by said longitudinal strip of release coating material and preferentially adhered to said one face of said web in said non-release coated region;

(e) cutting said web crosswise into a succession of separate elements, each having a left edge and a right edge; and (f) after conducting step (d), but prior to conducting step (e), die cutting succession of line-enclosed areas through said region of said web, so that each said element as created in step (e) contains at least one such area, as a removable, pressure-sensitive adhesive-backed member.

8. The method of claim 7, wherein:

steps of (b)-(f) are conducted on successive increments of said web as said web is continuously advanced.

* * * * *